US006840350B2

(12) United States Patent
Deal

(10) Patent No.: US 6,840,350 B2
(45) Date of Patent: Jan. 11, 2005

(54) ADJUSTABLE SCAFFOLD AND WALKBOARD LADDER HOLDER

(76) Inventor: Clifton Deal, 1379B Curtis Switch Rd., Mineral Bluff, GA (US) 30559

( * ) Notice: Subject to any disclaimer, the term of this patent is extended or adjusted under 35 U.S.C. 154(b) by 0 days.

(21) Appl. No.: 10/328,239

(22) Filed: Dec. 23, 2002

(65) Prior Publication Data

US 2003/0127283 A1 Jul. 10, 2003

Related U.S. Application Data

(63) Continuation-in-part of application No. 10/244,808, filed on Sep. 16, 2002, now abandoned.
(60) Provisional application No. 60/342,643, filed on Dec. 26, 2001.

(51) Int. Cl.[7] ..... E04G 3/00; E04G 3/10
(52) U.S. Cl. ..... 182/82; 182/150
(58) Field of Search ..... 182/150, 82, 45, 182/113, 108

(56) References Cited

U.S. PATENT DOCUMENTS

| | | | | | |
|---|---|---|---|---|---|
| 3,515,244 | A | * | 6/1970 | Weible | 182/150 |
| 4,565,261 | A | * | 1/1986 | Maier | 182/113 |
| 4,673,060 | A | * | 6/1987 | Gregory | 182/82 |
| 6,394,227 | B1 | * | 5/2002 | Frestad | 182/82 |
| 6,446,752 | B2 | * | 9/2002 | Philippe | 182/82 |
| 6,470,646 | B1 | * | 10/2002 | Bryant | 52/749.12 |

* cited by examiner

*Primary Examiner*—Hugh B. Thompson, II
(74) *Attorney, Agent, or Firm*—Clifford Kraft

(57) ABSTRACT

An adjustable universal safety scaffold and walkboard ladder holder that absolutely prevents scaffold collapse or dis-attachment from a construction project and absolutely prevents a ladder placed against a walkboard from slipping sideways. Vertical supports can attach attach top and bottom to the building or work under construction. Hold brackets that can be raised or lowered slide up and down the vertical supports. A walkway sits on the hold brackets and is positively held in place by pins. A ladder can be optionally leaned against the walkboard and secured by additional stay bolts into the walkboard to prevent horizontal slipping.

11 Claims, 7 Drawing Sheets

ADJUSTABLE SCAFFOLD AND WALKBOARD LADDER HOLDER

This application is a continuation-in-part of co-pending application Ser. No. 10/244,808 filed Sep. 16, 2002 now abandoned, and hereby incorporates that application by reference. This application also claims priority from U.S. Provisional application 60/342,643 filed Dec. 26, 2001 and hereby incorporates that application by reference.

BACKGROUND

1. Field of the Invention

The present invention relates to the field of construction scaffolds and more particularly to an adjustable universal scaffold bracket and walkboard ladder holder that absolutely prevents scaffold collapse or disattachment from a building and absolutely prevents a ladder placed against a walkboard from slipping sideways.

2. Background of the Invention

Prior art scaffolds are generally placed on buildings for construction without being tightly coupled to the building structure. In particular scaffolds are sometimes set up between ladders alongside a house or other building. A walkboard is run between the ladders or other supports and a ladder is leaned against the walkboard to allow a worker to mount the walkboard. Many times, the walkboard has no safety rail.

This situation results in many collapse and fall accidents in the construction trade. The ladder leaned against the walkboard can slip sideways and fall, especially if someone climbs it carrying an off-balance load, for example, in one hand. In addition, the scaffold itself can slip out of the support ladders or other supports or the supports can fall or collapse themselves. Falls from scaffolds result in grave injury to workers because of height and the fact that there may be hard ground, materials, tools, or concrete below. In addition to these hazards, many walkboards do not have any rails. This causes more accidents where workers lose balance and have nowhere to grab hold of.

What is badly needed is a safety scaffold that firmly attaches to the building that has a walkboard with rails and a means of preventing ladder slip of the mounting ladder.

SUMMARY OF THE INVENTION

The present invention as illustrated and described herein is a safety scaffold and bracket with a safety walkboard with rails that also contains a positive means of preventing ladder slip. Vertical supports can attach top and bottom to the building or work under construction. Hold brackets that can be raised or lowered slide up and down the vertical supports. A walkway sits on the hold brackets and is positively held in place by pins. The hold brackets can be held in place vertically by stay bolts that penetrate both the hold brackets and the vertical supports. The hold brackets can be equipped with vertical arms in the front so that posts can be place on them to form a place to put a guard rail. In addition a ladder can be optionally leaned against the walkway and secured by additional stay bolts into the walkway to prevent horizontal slipping. The ladder can be optionally secured from slipping by ladder spikes on its legs that penetrate the ground or hold a floor.

Figure 1:
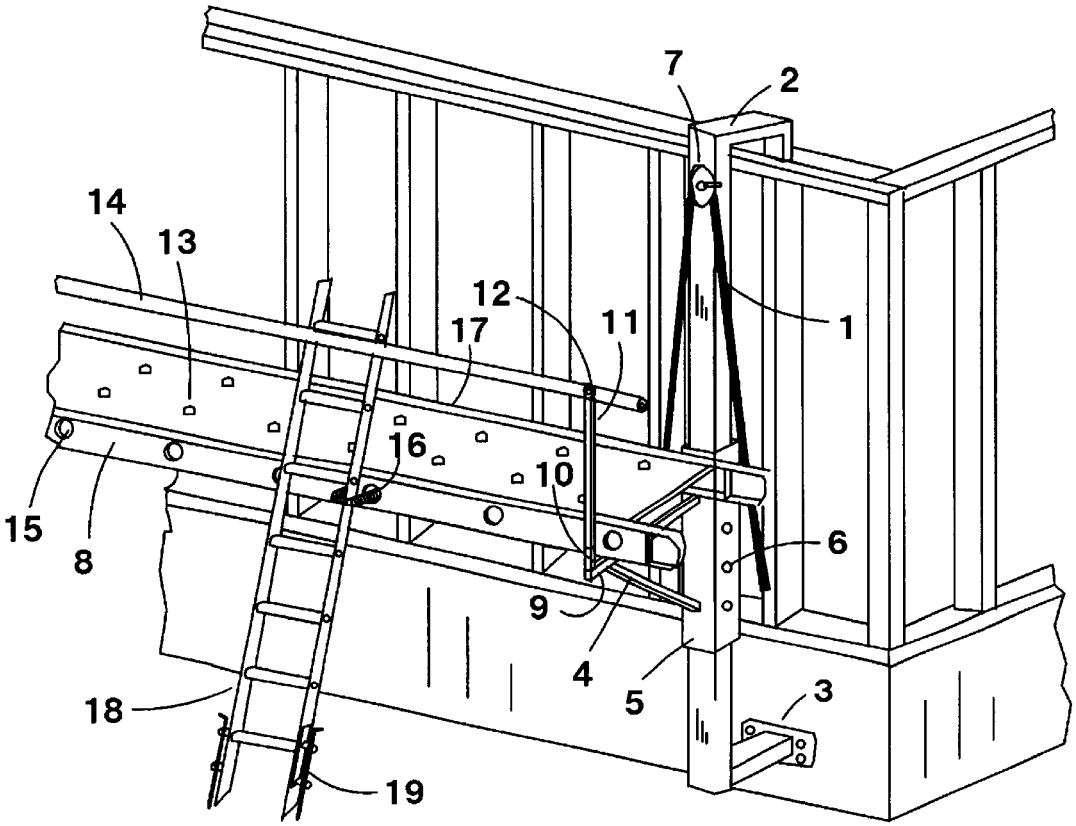
FIG. 1 shows a general view of an embodiment of the vertical supports, hold brackets, walkway, and optional ladder with optional leg spikes.

The above described drawings are only to illustrate the concepts and techniques of the present invention. It will be recognized by one skilled in the art that many other variations not shown in the drawings are possible and within the scope of the present invention.

DETAILED DESCRIPTION

As can be see in FIG. 1, the present invention can contain a pair of vertical supports 1 that can have a rectangular cross-section for convenience. These supports can be securely fastened to the building structure generally by a roof support 2 that either runs up over the top of the roof and positively prevents any downward motion of the structure and by a clamp or screw arrangement at the top and optionally the bottom 3. The preferred size of the vertical supports is rectangular of 4×4 or 6×6 inches. However, any other size or cross-section is within the scope of the present invention as long as the support is rigid enough to safely support the rest of the structure.

The bottoms of the vertical supports can be equipped with screw plates 3 that hold the bottom of the structure secure. They can be screwed into the building for greater safety. This structure results in the two vertical supports running up the outside of the building on the left and right of the scaffold with these supports unable to move in any direction.

On the two supports, at the level of the walkboard, can be two triangular hold brackets with bar supports 9, 4 of rigid material like steel that can be either bolted around the vertical supports or surround the vertical supports as a sleeve 5 and move past horizontal holes 6 where pins or stay bolts can be placed. For safety, stay bolts with nuts are highly recommended. In this manner, the supports can be raised and lowered as the job requires without any danger of unwanted slippage. The brackets 9 (sometimes called holding brackets) can optionally be pulled up and down when the stay bolts are removed with a rope and pulley 7 mounted on each side at the top. Each bracket 9 can have an angular support 4 for strength. The preferred vertical run of the triangular bracket can be about 42 inches. The bracket can preferably be made from 1 ¼ inch steel bar.

A walkboard 8 can be bolted to flat part the brackets 9 and also cannot slip. It can remain so bolted until the job is completed. On each end of the walkboard, attached to the bracket can be a stud 10 for holding a longer post 11 for a handrail 14. The handrail should be bolted to the bracket post at each end 12. It is possible to make the handrail post removable from the bracket for storage; however, when in use, it usually should be bolted to the bracket for safety. The handrail post 11 can slip over and be bolted to the vertical stud 10 to which it is bolted. The preferred size of the bracket post stud 10 is around 1×1 inch and at least 3–4 inches tall. It should also be steel and can be welded to the walkboard support bracket.

The walkboard 8 can be an elongated rectangular tube or plate with a rough surface or grating 13 for slip safety. It can have a top and bottom surface covering two elongated side posts or be any other type of walkboard. In addition, it can have a series of holes 15 along its front and rear faces. Into these holes can be inserted tubular ladder hold brackets or "ladder lock" pieces 16. These can be metal tubes or solid bolts about 22 inches long that make a squared U shape at one end. The end of the U can have an optional plastic cap. The ladder lock pieces 16 can be inserted into the holes 15 in the walkboard and extend all the way through the walkboard exiting in the rear. Stay pins 17 can be inserted through a series of holes in the hold bracket. Squared U shaped, or other shaped, the fronts of the hold brackets can wrap around the two vertical sides of the mounting ladder 18 and hold the mounting ladder securely from slipping or falling. The preferred material for the hold brackets is ¾ inch aluminum tubing. The preferred material for the walkboard is aluminum, and the preferred material for the vertical supports and brackets is steel. The foot of the optional ladder 18 can be secured to the ground or floor with safety spikes 19.

Generally the rail post 11 can be designed for a 2×4 inch rail (common 2×4 wood) or other rail. The preferred distance for the vertical supports from the building is around 8 inches. The preferred span or distance between the vertical supports is around 12 feet although many other spans are possible. The preferred outward reach of the walkboard support brackets is around 26 inches. The walkboard support bracket should form a triangle and be welded everywhere with certified welds.

Figure 2:
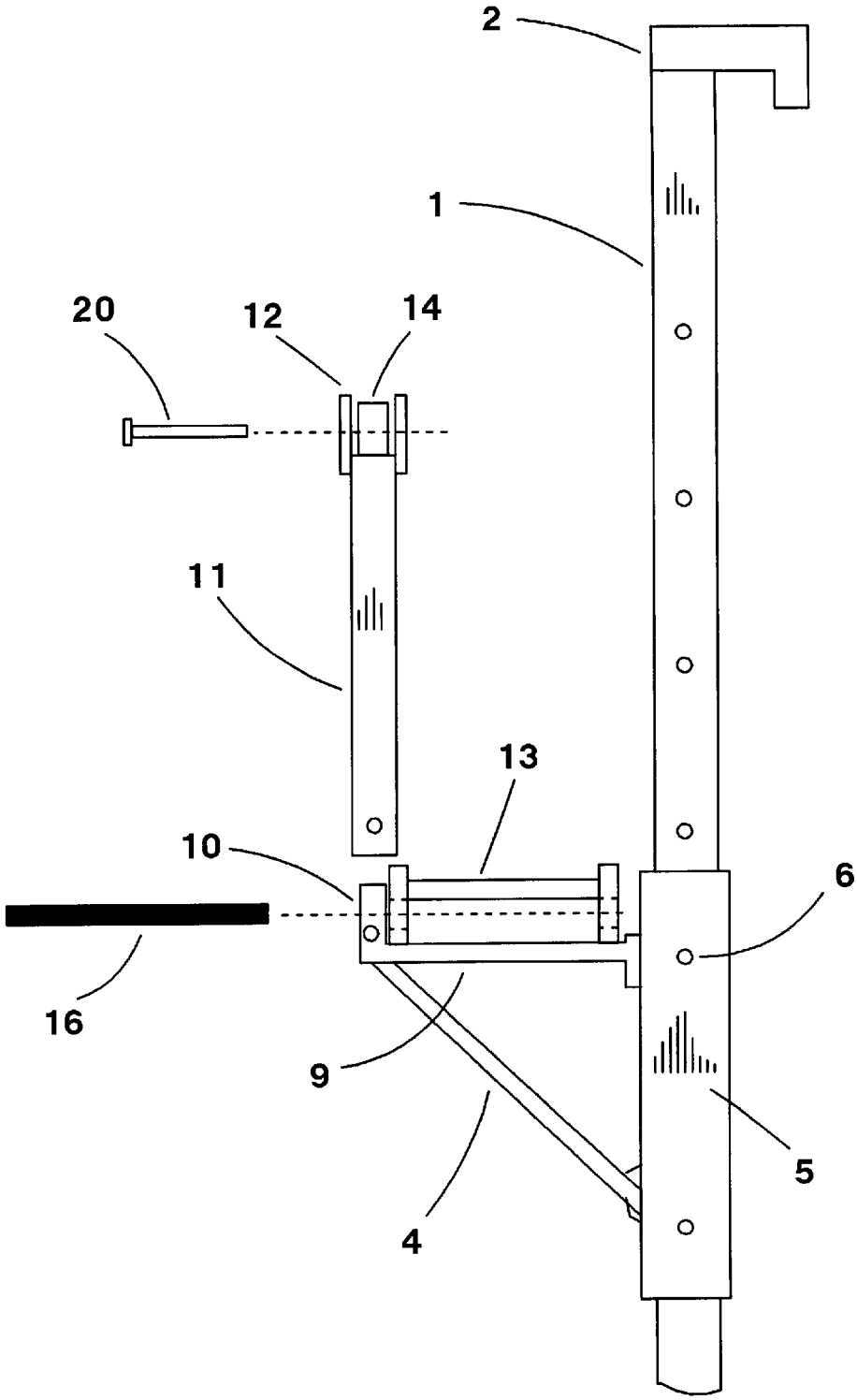
FIG. 2 shows an end view of one of the support assemblies.

FIG. 2 shows a side view of an embodiment of one vertical support 1. A sliding sleeve 5 can move snugly, but smoothly, up and down. An optional top piece 2 allows the vertical to be coupled to the top of a wall or into an roof eve. A horizontal bar 9 is supported by an angle support 4 to form a bracket. A horizontal walkboard 13 can be supported by the bar 9. An optional ladder lock piece or hold bracket 16 can be inserted into and through optional holes in the walkboard 13. At the end of the horizontal bar 9, a vertical stub 10 can be used to attach a handrail bar 11. A handrail 14 can be held on the handrail bar 11 by use of a two receiving plates 12 and a pin 20 which is inserted through holes in the receiving plates 12.

Figure 3:
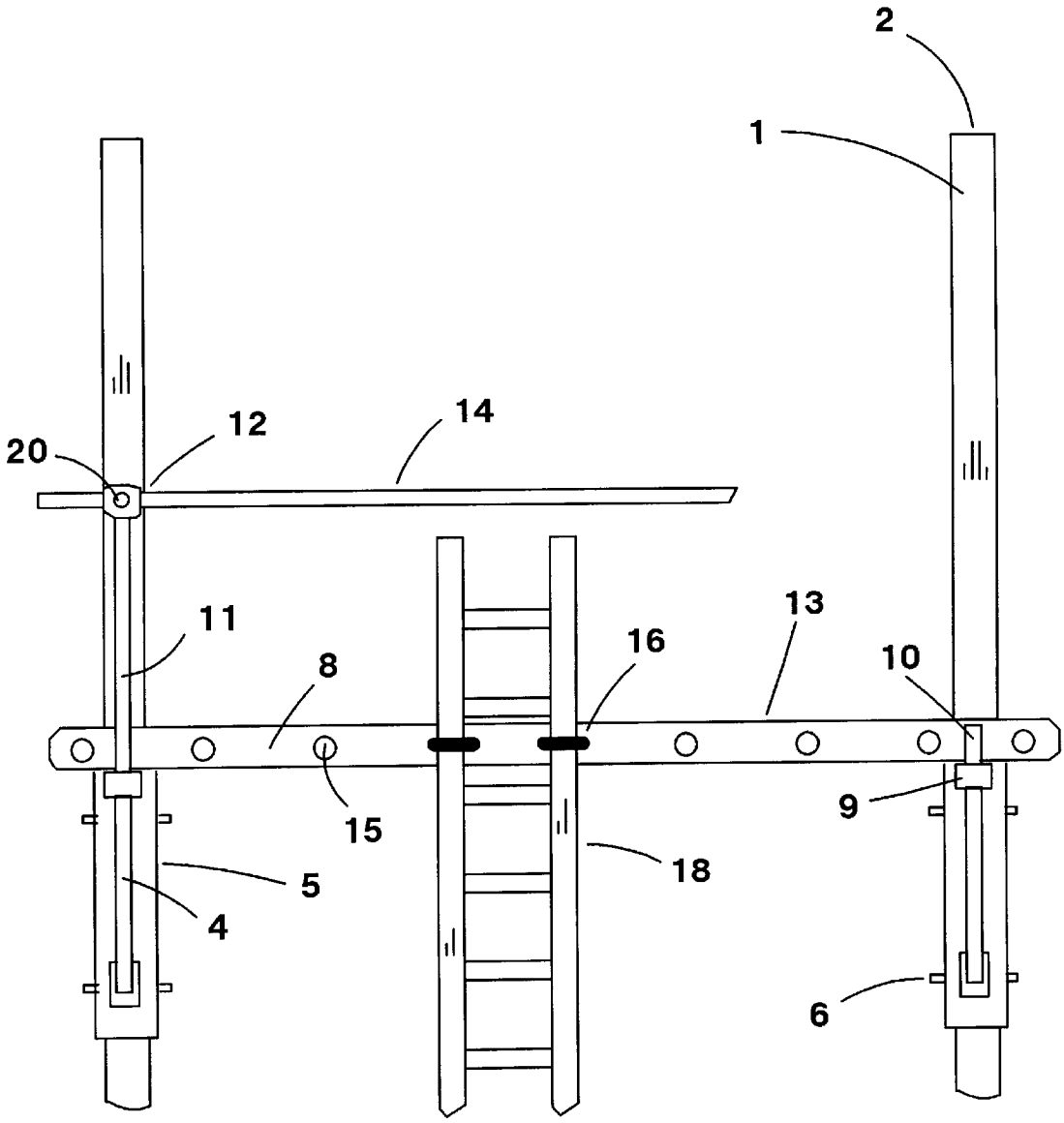
FIG. 3 shows a front view of an embodiment of the invention.

FIG. 3 shows a front-on view of the embodiment of FIG. 2. Here optional pins 6 are seen holding the sleeve 5 at a predetermined vertical position. A ladder 18 is shown leaning against the flat side 8 of the walkboard 13. Two optional ladder lock pieces 16 are shown to hold the ladder from slipping. These lock pieces 16 pass through holes 15 in the face of the walkboard 8. The pins 16 optionally pass all the way through the walkboard 13 and exit on the back side where they can also be secured with insert pins (not shown).

Figure 4D:
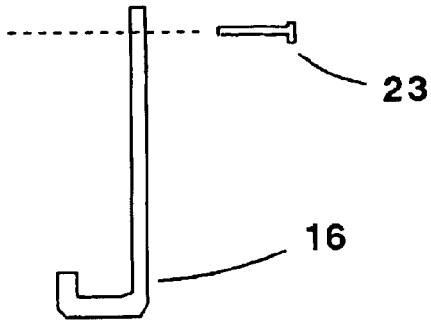
FIG. 4D shows the safety spike with retaining pin.
Figure 4C:
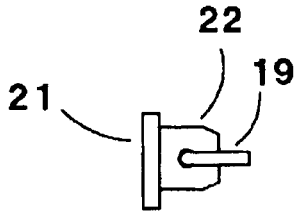
FIG. 4C shows a top view of the safety spike and bracket.
Figure 4A:
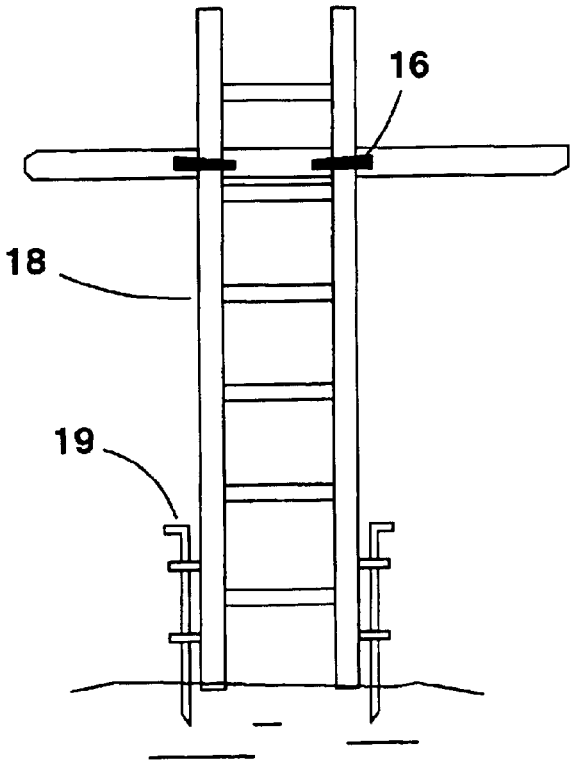
FIG. 4A shows the ladder with optional safety spikes.
Figure 4B:
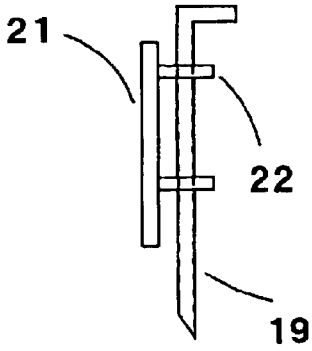
FIG. 4B shows a side view of the safety spike and bracket.

FIG. 4A shows the ladder arrangement of FIG. 3. The ladder 18 can be held from slipping along the walkboard by ladder lock pieces 16. Optional ladder spikes 19 can be used to secure the ladder into soil or onto a floor to keep its legs from slipping. FIG. 4B shows a detail of a possible embodiment of such a ladder spike 19. A bracket 21 is attached to the face of the ladder either with bolts or rivets. The bracket 21 has flanges 22 that hold the spike 19. FIG. 4C shows a top view of the bracket 21, flanges 22 and one spike 19. FIG. 4D shows a detail of a possible embodiment of a ladder lock piece 16 with the safety pin 23 shown. It should be remembered that this lock piece 16 can pass all the way through the walkboard and be pinned on the back.

Figure 5:
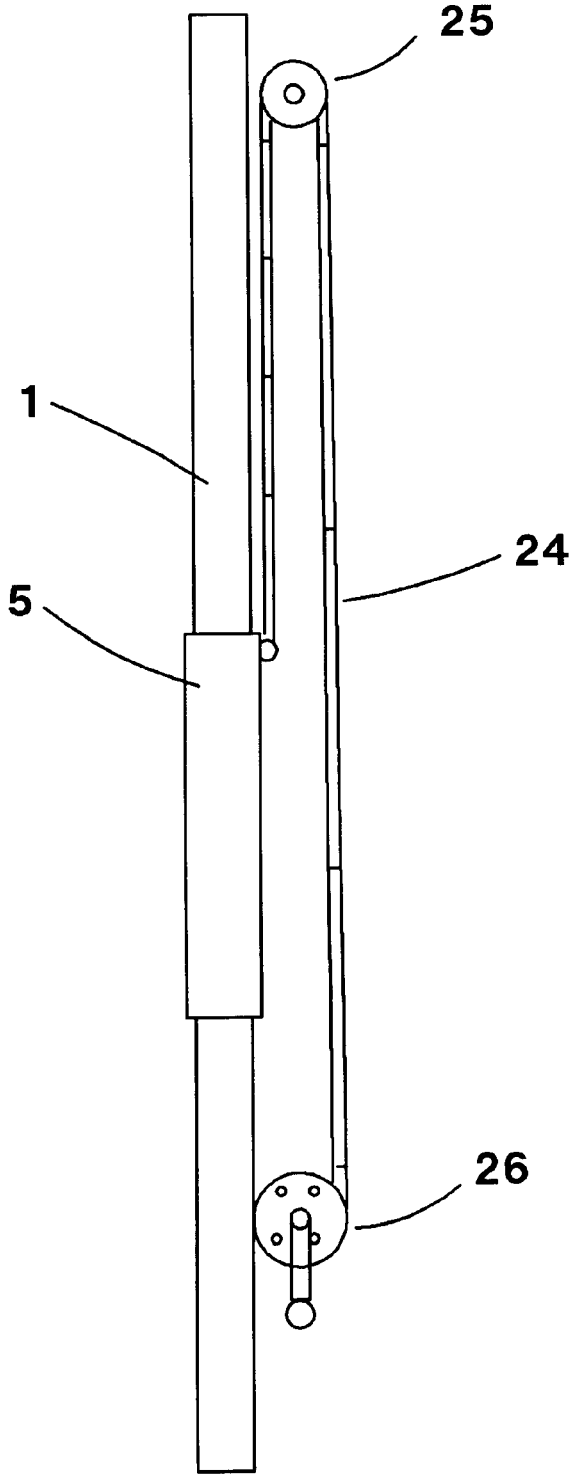
FIG. 5 shows one of the verticals with a hoist rope and pulley system.

FIG. 5 shows another embodiment of a vertical support 1. The sleeve 5 can move vertically along the piece being pulled with a rope 24 over a pulley 25 from a crank 26.

Figure 6:
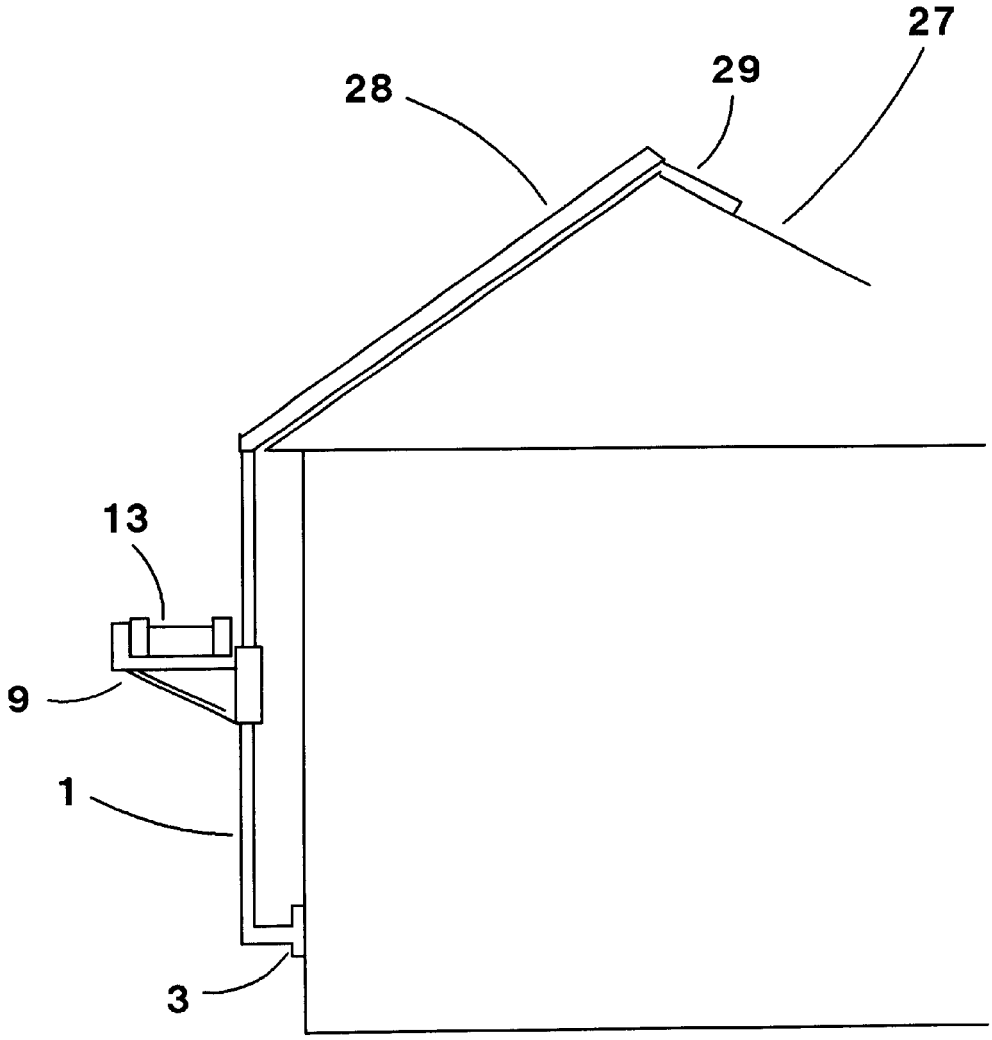
FIG. 6 shows an embodiment of the vertical supports that attach over the top of a pitched roof.

FIG. 6 shows an embodiment of the present invention where the vertical supports are held by an assembly 28 that lies on a pitched roof 27 and reaches up over the top of the roof 29. An optional extension can run down the second side of the roof support.

Figure 7:
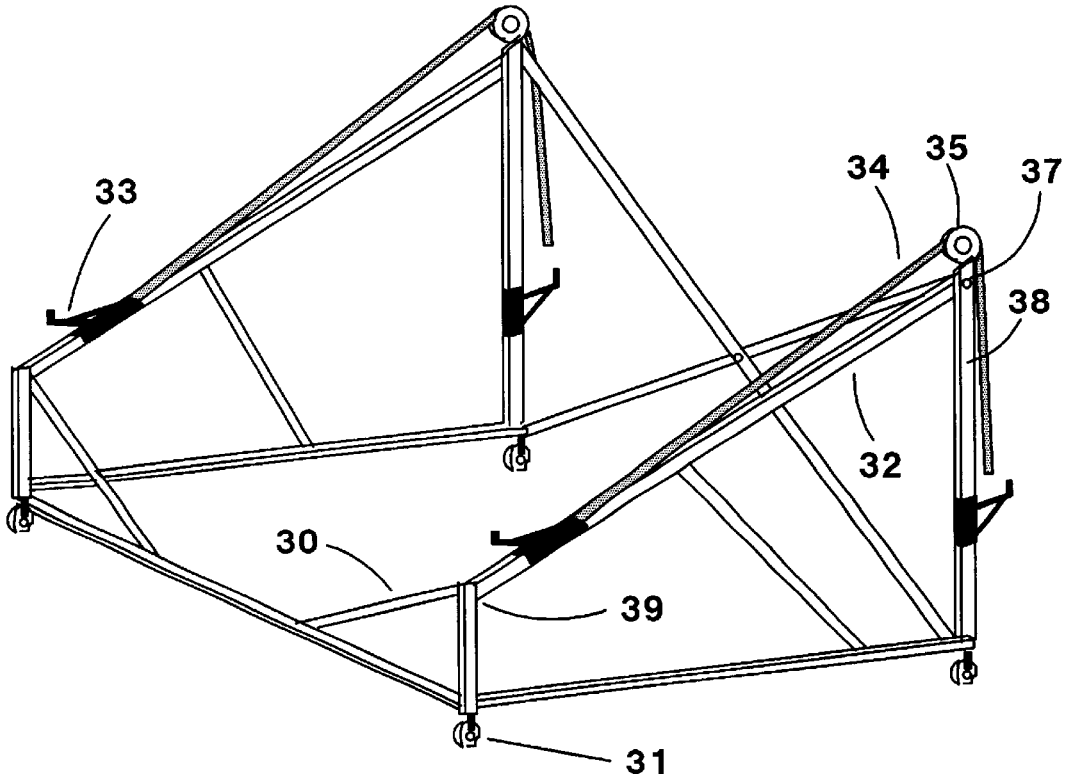
FIG. 7 shows an embodiment of the invention for inside cathedral ceiling and other work.

FIG. 7 shows another embodiment of the present invention in the form of a roll-up scaffold support. This embodiment can be used at angles from 0 degrees to around 45 degrees or more for inside construction especially of cathedral ceilings. A rollup frame 30 has wheels or rollers 31 for rolling into a tight corner. An angular beam runs from front to back at approximately 45 degrees from the horizontal. Angle brackets 33 allow this frame to hold a scaffold or walkway. A rope 34 and pulley 35 with a crank 36 can be used to raise and lower the walkboard. The exact angle of the frame is controlled by pins 37 through holes 38 in the long side of the frame. A pivot 39 connects the side of the frame to the front and allows the frame to take any angle.

The present invention provides a safe manner of completing a construction project by providing a manner of positively attaching vertically sliding holding brackets to at least two vertical supports and positively attaching a walkboard between the holding brackets. Positive attachment can be accomplished through the use of pins, bolts, clamps, screws, nuts or by any other means that allows movement and removal when not in service and positive locking safety attachment when in service. Additional safety pins and clips can be used as needed for further safety.

It should be understood that the present invention as here-in described in the text and figures is only illustrative of the concepts and teachings of the invention and that many more embodiments and techniques would be understood by one skilled in the art and are within the scope of the present invention.

I claim:

1. An adjustable safety scaffold and walkboard holder designed to prevent collapse accidents comprising:

at least two vertical supports, said vertical supports being elongated columns adapted to be attached to a construction project top and bottom;

at least one holding bracket coupled to each vertical support, said holding bracket adjustable on said vertical support, said holding bracket sliding vertically along said vertical support;

said holding bracket being capable of being positively locked in at least one vertical position along said vertical support;

a removable horizontal walkboard supported by said holding brackets, said walkboard being positively attached to said holding brackets when in service; and holes in a front face of said walkboard, said holes receiving U-shaped lock pins or bolts for holding a ladder against said walkboard.

2. The adjustable safety scaffold of claim 1 wherein said holding brackets are triangular trusses.

3. The adjustable safety scaffold of claim 1 further comprising a pitch roof piece extending from said vertical supports up over a pitched roof, said pitch roof piece also extending for a distance down an opposite side of said pitched roof.

4. The adjustable safety scaffold of claim 1 further comprising vertical hand rail studs attached to said holding brackets, said hand rail studs receiving vertical handrail posts, said vertical handrail posts supporting a horizontal handrail running between said vertical supports.

5. The adjustable safety scaffold of claim 1 where the cross-section of said walkboard forms a web.

6. A safety scaffold used in construction of buildings where workers are supported at a variable height as they work against a side of the building while framing, attaching finishing material or paint to the building, the safety scaffold comprising at least two vertical beams of substantially rectangular cross-section, these beams being separated by a distance and both adapted to be attached to the building both top and bottom by at least one of screws, pins, clamps, and bolts; each of the beams supporting a sliding holding bracket formed as a triangular truss, the holding bracket being locked in useful vertical positions by at least one of screws, pins, clamps, and bolts, the holding brackets having a horizontal arm that receives a horizontal walkboard between the two holding brackets, the horizontal walkboard being positively attached to the holding brackets by at least one of screws, pins clamps, and bolts and holes in a front surface of the walkboard with at least one ladder lock pin engaging at least one of said holes, the at least one ladder lock pin locked from slipping out by at least one of safety pins, a clamp, and nut, said ladder lock pin adapted to hold an access ladder leaned against the walkboard from slipping sideways.

7. A method of preventing accidents on scaffolds comprising the steps of:

attaching two vertical supports to a building top and bottom;

positively attaching two holding brackets to said supports, one to each support;

using said holding brackets to hold a horizontal walkway, said walkway positively attached to said holding brackets;

providing vertical handrail support stubs on said holding brackets to receive handrail posts;

attaching handrail supports onto said handrail support stubs by slipping said handrail posts over said handrail support stubs and then positively attaching said handrail posts to said support stubs;

coupling a horizontal handrail between said handrail posts thus providing a handrail located rearward of said walkboard and using at least one ladder lock pin inserted into a front surface of said walkboard to hold an access ladder from sliding sideways.

8. The method of claim 7 further comprising attaching said vertical supports up and over a pitched roof using a pitched roof piece that runs up one side of a pitched roof and a distance down a second side of said pitched roof.

9. The method of claim 7 wherein said ladder lock pin penetrates said front surface of said walkboard and also penetrates a rear surface of said walkway.

10. The method of claim 9 wherein said ladder lock pin receives at least one additional safety pin behind said read surface of said walkboard, said safety pin penetrating said ladder lock pin and preventing it from slipping out.

11. The method of claim 7 wherein said holding brackets are triangular trusses.

* * * * *